US010612832B2

(12) United States Patent
Iwamoto et al.

(10) Patent No.: US 10,612,832 B2
(45) Date of Patent: Apr. 7, 2020

(54) REFRIGERATOR WITH DEFROST OPERATION CONTROL

(71) Applicant: Samsung Electronics Co., Ltd., Suwon-si (KR)

(72) Inventors: Tomoharu Iwamoto, Yokohama (JP); Kazuo Shimizu, Yokohama (JP); Aiko Mori, Yokohama (JP); Tatsuya Seo, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/368,012

(22) Filed: Dec. 2, 2016

(65) Prior Publication Data

US 2017/0176084 A1 Jun. 22, 2017

(30) Foreign Application Priority Data

Dec. 17, 2015 (JP) ..... 2015-246469
Dec. 25, 2015 (JP) ..... 2015-255166
(Continued)

(51) Int. Cl.
*F25D 21/00* (2006.01)
*F25D 17/04* (2006.01)
(Continued)

(52) U.S. Cl.
CPC ..... *F25D 21/002* (2013.01); *F25B 39/02* (2013.01); *F25B 41/04* (2013.01); *F25B 49/02* (2013.01);
(Continued)

(58) Field of Classification Search
CPC .... F25D 17/045; F25D 17/062; F25D 17/065; F25D 21/002; F25D 21/08; F25D 21/125; F25D 21/12
See application file for complete search history.

(56) References Cited

U.S. PATENT DOCUMENTS 3,103,796 A * 9/1963 Dickson ..... A47F 3/0447 62/234
4,312,190 A * 1/1982 Ibrahim ..... F25D 21/06 62/156
(Continued)

FOREIGN PATENT DOCUMENTS

CN 1702411 11/2005
CN 103033017 4/2013
(Continued)

OTHER PUBLICATIONS

KR100526603 English Translation.*
(Continued)

*Primary Examiner* — Nelson J Nieves
(74) *Attorney, Agent, or Firm* — Staas & Halsey LLP

(57) ABSTRACT

A refrigerator includes a storage chamber, an evaporator configured to cool the storage chamber, and an air passage through which cold air generated by the evaporator flows. The air passage includes a blower fan configured to blow the cold air to the storage chamber, and a trap part in which warm air generated by a defrosting operation stays, such that warm air generated by the defrosting operation is prevented from being introduced into the inner space of the refrigerator through the air passage. The refrigerator reduces the defrosting operation time, efficiently prevents increase of the inner temperature of the refrigerator due to warm air during the defrosting operation, reduces a temperature difference in inner temperature of the refrigerator, and prevents food stored in the refrigerator from being rotten due to a temperature change.

11 Claims, 14 Drawing Sheets

(30) Foreign Application Priority Data

| | | |
|---|---|---|
| Apr. 7, 2016 | (JP) | 2016-076994 |
| May 18, 2016 | (JP) | 2016-099295 |
| Jul. 26, 2016 | (KR) | 10-2016-0095021 |

(51) Int. Cl.

| | |
|---|---|
| ***F25D 17/06*** | (2006.01) |
| ***F25D 21/08*** | (2006.01) |
| ***F25B 49/02*** | (2006.01) |
| ***F25B 39/02*** | (2006.01) |
| ***F25D 21/06*** | (2006.01) |
| ***F25B 41/04*** | (2006.01) |
| ***F25D 29/00*** | (2006.01) |

(52) U.S. Cl.

CPC ..... *F25D 17/045* (2013.01); *F25D 17/06* (2013.01); *F25D 17/062* (2013.01); *F25D 17/065* (2013.01); *F25D 21/06* (2013.01); *F25D 21/08* (2013.01); *F25D 29/00* (2013.01); *F25B 2400/23* (2013.01); *F25B 2500/26* (2013.01); *F25B 2600/2507* (2013.01); *F25B 2700/2103* (2013.01); *F25D 2317/063* (2013.01); *F25D 2600/02* (2013.01); *F25D 2600/04* (2013.01)

(56) References Cited

U.S. PATENT DOCUMENTS

| | | | | |
|---|---|---|---|---|
| 5,369,963 | A * | 12/1994 | Pickles | F25D 17/045 62/408 |
| 2002/0184904 | A1* | 12/2002 | Wellman | A47F 3/0443 62/186 |
| 2006/0117768 | A1* | 6/2006 | Lee | F25D 21/08 62/151 |
| 2006/0218962 | A1 | 10/2006 | Marques et al. | |
| 2006/0272340 | A1* | 12/2006 | Petrenko | F25C 1/12 62/73 |
| 2007/0000271 | A1* | 1/2007 | Lee | F25B 39/022 62/276 |
| 2007/0028643 | A1* | 2/2007 | Revlett | F25D 17/065 62/407 |
| 2007/0044498 | A1* | 3/2007 | Kang | F25B 39/022 62/276 |
| 2007/0130979 | A1* | 6/2007 | Norrby | A47F 3/0443 62/255 |
| 2008/0196429 | A1* | 8/2008 | Petrenko | F25C 1/12 62/207 |
| 2009/0165486 | A1* | 7/2009 | Harlen | F25D 21/08 62/276 |
| 2011/0073586 | A1* | 3/2011 | Lim | F25D 21/08 219/546 |
| 2012/0096887 | A1* | 4/2012 | Cho | F25D 17/065 62/276 |
| 2013/0081416 | A1* | 4/2013 | Kim | F25D 21/006 62/151 |
| 2013/0086928 | A1 | 4/2013 | Cho et al. | |
| 2014/0157812 | A1* | 6/2014 | Hwang | F25D 17/062 62/285 |
| 2015/0082817 | A1* | 3/2015 | Stark | F25D 21/125 62/82 |
| 2016/0153694 | A1* | 6/2016 | Ko | F25D 17/065 62/186 |
| 2017/0241696 | A1* | 8/2017 | Ma | F25D 11/00 |

FOREIGN PATENT DOCUMENTS

| | | |
|---|---|---|
| CN | 104279812 | 1/2015 |
| CN | 104390415 | 3/2015 |
| JP | 10-318645 | 12/1998 |
| JP | 11-132634 | 5/1999 |
| JP | 3130804 | 1/2001 |
| JP | 2002-147917 | 5/2002 |
| JP | 2005-172302 | 6/2005 |
| JP | 2006-71248 | 3/2006 |
| JP | 2010-60188 | 3/2010 |
| JP | 2010-216680 | 9/2010 |
| JP | 2011-7435 | 1/2011 |
| JP | 2013-204891 | 10/2013 |
| JP | 2015-222131 | 12/2015 |
| KR | 1999-0042663 | 6/1999 |
| KR | 10-2003-0028952 | 4/2003 |
| KR | 10-2005-0061164 | 6/2005 |
| KR | 10-0526603 | 10/2005 |
| KR | 10-2014-0017880 | 2/2014 |
| KR | 10-1450664 | 10/2014 |
| WO | 2013/143383 | 10/2013 |

OTHER PUBLICATIONS

International Search Report dated Apr. 5, 2017 in corresponding International Patent Application No. PCT/KR2016/014651.

European Communication dated Nov. 9, 2018 in European Patent Application No. 16876021.3.

Extended European Search Report dated Mar. 7, 2019 in European Patent Application No. 16876021.3.

Chinese Office Action dated Nov. 6, 2019 in Chinese Patent Application No. 201680073477.X.

European Communication under Rule 71(3) dated Jan. 16, 2020 in European Patent Application No. 16876021.3.

* cited by examiner

FIG. 3

| | | REFRIGERATING COOLING | FREEZING COOLING | DEFROSTING OPERATION | | |
|---|---|---|---|---|---|---|
| | | | | DEFROSTING START | REACH T1 | REACH T2 |
| FLOW PASSAGE SWITCHING VALVE | FREEZING-CHAMBER PORT | CLOSE | OPEN | OPEN | CLOSE | CLOSE |
| | REFRIGERATING-CHAMBER PORT | OPEN | CLOSE | OPEN | OPEN | CLOSE |
| HEATER CONTROL | UPPER HEATER | OFF | | OUTPUT 100% | INCREASE AND DECREASE CONTROL | OFF |
| | LOWER HEATER | OFF | | OUTPUT 100% | INCREASE AND DECREASE CONTROL | OFF |

FIG.4

| | D < T1 | T2 > D ≥ T1 | T1 = T2 |
|---|---|---|---|
| FLOW PASSAGE SWITCHING VALVE | OPEN FREEZING-CHAMBER PORT | CLOSE | CLOSE |
| UPPER HEATER OUTPUT | 100% | OUTPUT CONTROL FUNCTION 100-100×(D-T1)/(T2-D) | 0% |
| LOWER HEATER OUTPUT | 100% | OUTPUT CONTROL FUNCTION 100-100×(D-T1)/(XT2-D) | 50% |

REFRIGERATOR WITH DEFROST OPERATION CONTROL

CROSS-REFERENCE TO RELATED APPLICATIONS

This application claims the benefit of Korean Patent Application No. 10-2016-0095021, filed on Jul. 26, 2016 in the Korean Intellectual Property Office, the disclosure of which is incorporated herein by reference.

This application claims the benefit of Japanese Patent Application No. 2015-246469, filed on Dec. 17, 2015 in the Japanese Patent Office, the disclosure of which is incorporated herein by reference.

This application claims the benefit of Japanese Patent Application No. 2015-255166, filed on Dec. 25, 2015 in the Japanese Patent Office, the disclosure of which is incorporated herein by reference.

This application claims the benefit of Japanese Patent Application No. 2016-076994, filed on Apr. 7, 2016 in the Japanese Patent Office, the disclosure of which is incorporated herein by reference.

This application claims the benefit of Japanese Patent Application No. 2016-099295, filed on May 18, 2016 in the Japanese Patent Office, the disclosure of which is incorporated herein by reference.

BACKGROUND

1. Field

Embodiments of the present disclosure relate to a refrigerator, and more particularly to a technology for increasing efficiency of a refrigerator using the internal structure of the refrigerator, and efficiently defrosting the refrigerator using a defrosting heater and a blower fan.

2. Description of the Related Art

Generally, a refrigerator stores foods or beverages (hereinafter referred to as "stored good") in a fresh state for a long time using cold air. The refrigerator generally classifies a storage chamber into a refrigerating chamber for storing the stored goods at a temperature above zero and a freezing chamber for storing the stored goods at a temperature below zero.

The refrigerator repeatedly performs a cooling cycle for sequentially performing compression→condensation→expansion→evaporation of a refrigerant, such that it allows the inner space of the storage chamber to be kept at a target temperature. In other words, the refrigerator provides cold air cooled by an evaporator arranged in each storage chamber to each storage chamber such that each storage chamber can be kept at a target temperature.

The evaporator evaporates the refrigerant to cool the storage chamber. During evaporation of the refrigerant, frost is formed at the evaporator. A defrosting heater is formed at the refrigerator to remove frost formed on the evaporator.

A representative technology for removing the frost formed at the evaporator mounts a heater to the evaporator so that the frost formed at the evaporator can be melted and removed by the heater.

In more detail, as can be seen from Japanese Patent Laid-open Publication No. 2010-216680, the heater and a temperature sensor are mounted to each evaporator, such that heater operation can be controlled by a temperature detected by the corresponding evaporator temperature sensor.

According to technology of Japanese Patent Laid-open Publication No. 2010-216680, after a heater is driven to activate defrosting, a temperature of the evaporator is measured using a temperature sensor of the evaporator, such that the operation time of the heater can be reduced. In more detail, a pattern of the heater (i.e., the driving and stoppage of the heater) can be controlled according to a detection temperature of the evaporator temperature sensor.

However, according to technology of Japanese Patent Laid-open Publication No. 2010-216680, since the defrosting process is achieved by controlling the heater using a predetermined pattern, a time needed to finish defrosting is consumed, such that there is a high possibility of increasing a temperature of the inner space of the refrigerator during the defrosting process. Therefore, there is a high probability that food or beverages stored in the refrigerator become rotten.

In addition, if the remaining frost is present after completion of the defrosting operation, or if frost is concentrated only at a specific part of the inner space of the refrigerator, there is a need to maintain the output of the heater at a predetermined level or higher so as to remove the remaining frost. For this purpose, a conventional refrigerator according to the related art is designed to control the output of the heater.

Therefore, the conventional refrigerator unavoidably stops the defrosting process although the defrosting process must be continuously performed, such that a heater output level for such defrosting may be deteriorated.

SUMMARY

Therefore, it is an aspect of the present disclosure to provide a refrigerator in which a technology for modifying an internal structure of a refrigerator, more efficiently performing a defrosting operation using a plurality of defrosting heaters and a plurality of blower fans, and preventing increase of a temperature of the internal space of the refrigerator by reducing a defrosting time.

Additional aspects of the invention will be set forth in part in the description which follows and, in part, will be obvious from the description, or may be learned by practice of the invention.

In accordance with one aspect of the present disclosure, a refrigerator includes a storage chamber, an evaporator configured to cool the storage chamber, and an air passage through which cold air generated by the evaporator flows. The air passage of the refrigerator may include a blower fan configured to blow the cold air generated by the evaporator to the storage chamber, and a trap part configured to maintain warm air guided away from the air passage while the warm air is generated by a defrosting operation.

The air passage may further include an opening/closing damper configured to control movement of the cold air.

The refrigerator may further include: a plurality of spray parts configured to distribute cold air into the storage chamber; and partition parts formed at both sides of the plurality of spray parts. The air passage may be a space disposed between the partition parts, and the trap part may be an outer space of the partition parts.

The refrigerator may further include an opening part and a guide part formed at both sides of an opening/closing damper in such a manner that a refrigerant is introduced into the trap part when the opening/closing damper is closed.

The guide part may be extended by a predetermined length in a direction of the partition parts such that the guide part is longer than a lowermost end of the partition parts by the predetermined length.

The predetermined length may range from 10 mm to 100 mm.

The trap part may include a cooling material or a heat storage material.

The refrigerator may further include a controller configured to control an opening/closing damper and an opening part. The controller may close the opening/closing damper during a defrosting operation, and may open the opening/closing damper after completion of the defrosting operation.

After completion of the defrosting operation, if a difference between an inner temperature of the storage chamber and an inner temperature of the evaporator satisfies a predetermined value, or if a predetermined time elapses, the controller may open the opening/closing damper and may drive the blower fan.

If the opening/closing damper is opened, the controller may close the opening part to prevent a refrigerant from being introduced into the trap part.

The refrigerator may further include: at least one defrosting heater to remove frost formed on the evaporator, wherein the at least one defrosting heater is arranged at an upper part and a lower part of the evaporator.

During the defrosting operation, the defrosting heater located at the lower part of the evaporator may have a higher output level than the other defrosting heater located at the upper part of the evaporator.

The blower fan may rotate in a reverse direction when the defrosting heater located at the upper part of the evaporator and the other defrosting heater located at the lower part of the evaporator.

In accordance with another aspect of the present disclosure, a refrigerator includes: a storage chamber; an evaporator configured to cool the storage chamber; a compressor configured to compress a refrigerant evaporated by the evaporator; a flow passage switching valve configured to switch a flow passage of the refrigerant to the evaporator; a defrosting heater configured to remove frost formed on the evaporator; a temperature sensor configured to measure a temperature of the evaporator; and a controller configured to stepwise control an output level of the defrosting heater and an opening or closing of the flow passage switching valve on the basis of the measured temperature.

If the measured temperature is lower than a first temperature after the defrosting heater is driven, the controller may open the flow passage switching valve, and may maximize the output of the defrosting heater or increases the output of the defrosting heater in a stepwise manner.

If the measured temperature reaches a first temperature or if a change rate per unit time of the measured temperature is less than a predetermined change rate value, the controller may close the flow passage switching valve and may reduce the output of the defrosting heater in a stepwise manner.

The defrosting heater may be arranged at an upper part of the evaporator; the refrigerator may further comprise the other defrosting heater arranged at a lower part of the evaporator; and the controller may control the output of the other defrosting heater located at the lower part of the evaporator to be higher than the output of the defrosting heater arranged at the upper part of the evaporator.

In accordance with another aspect of the present disclosure, a refrigerator includes: a first storage chamber, a second storage chamber configured to store goods at a temperature different from that of the first storage chamber, a first evaporator configured to cool the first storage chamber and a second evaporator configured to the second storage chamber, a first defrosting heater configured to remove frost formed on the first evaporator and a second defrosting heater configured to remove frost formed on the second evaporator, a first blower fan arranged outside the first evaporator, and a second blower fan arranged outside the second evaporator; and a controller, if a first hour elapses after the first defrosting heater is driven, configured to drive the second defrosting heater and stop the second blower fan.

If the first defrosting heater and the second defrosting heater stop operation, the controller may not drive the first blower fan until a second time elapses, or may control the first blower fan to be driven at a lower output level than a maximum output level thereof.

The refrigerator may further include: a temperature sensor configured to measure a temperature of the second evaporator, wherein the controller drives the second blower fan when the temperature measured by the temperature sensor reaches a predetermined temperature.

BRIEF DESCRIPTION OF THE DRAWINGS

These and/or other aspects of the invention will become apparent and more readily appreciated from the following description of the embodiments, taken in conjunction with the accompanying drawings of which:

FIG. 3 is a conceptual diagram illustrating a method for controlling flow passage switching valves and heaters according to a temperature change during the defrosting operation according to a first embodiment of the present disclosure.

FIG. 4 is a conceptual diagram illustrating a method for controlling flow passage switching valves and heaters according to temperature change during the defrosting operation according to a second embodiment of the present disclosure.

DETAILED DESCRIPTION

Figure 1:
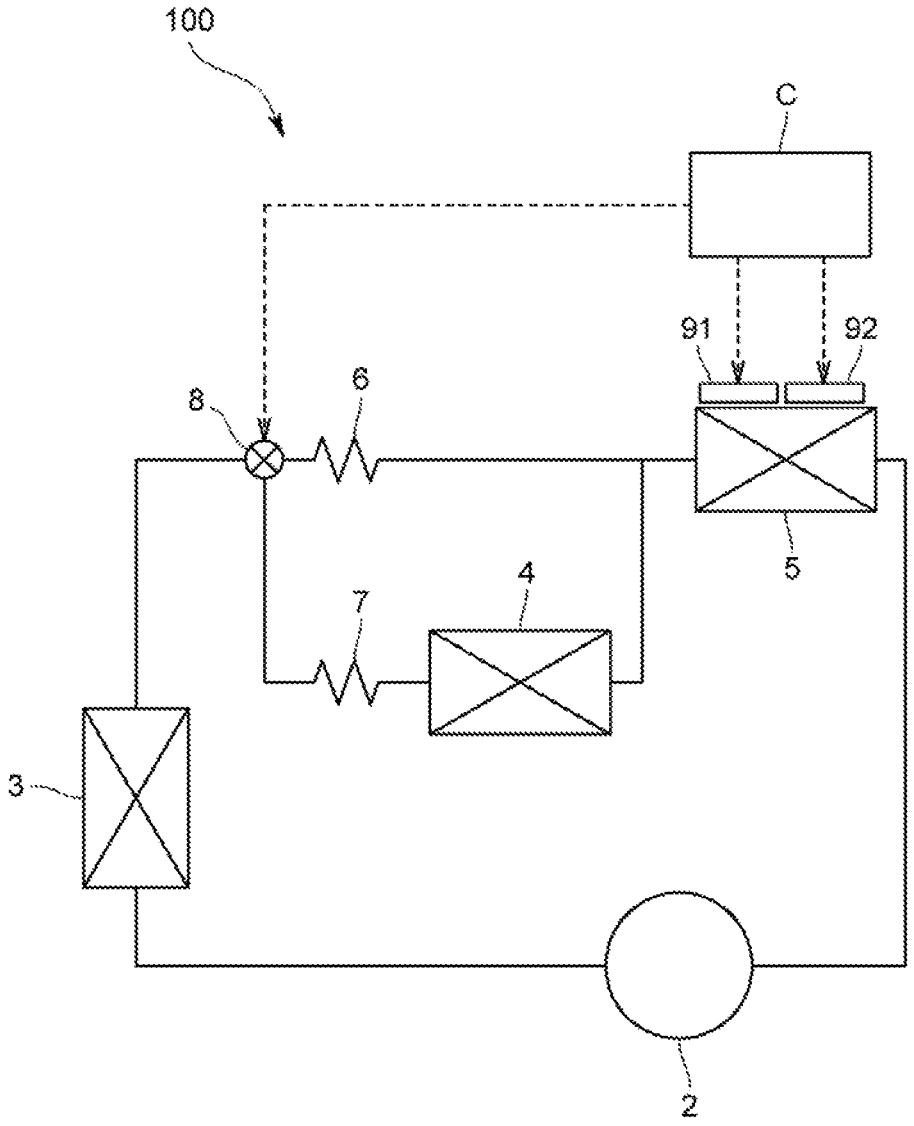
FIG. 1 is a conceptual diagram illustrating a cooling cycle of a refrigerator according to an embodiment of the present disclosure.

Reference will now be made in detail to the embodiments of the present disclosure, examples of which are illustrated in the accompanying drawings, wherein like reference numerals refer to like elements throughout.

The terms used in the present application are merely used to describe specific embodiments and are not intended to limit the present invention. A singular expression may include a plural expression unless otherwise stated in the context.

In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present invention, the terms "first" and "second" may be used to describe various components, but the components are not limited by the terms. The terms may be used to distinguish one component from another component. For example, a first component may be called a second component and a second component may be called a first component without departing from the scope of the present invention. The term "and/or" may include a combination of a plurality of items or any one of a plurality of items.

Issues of the related art, and features and various embodiments of the present disclosure will hereinafter be described.

According to technology for removing frost formed at the evaporator, the heater and the evaporator temperature sensor are mounted to each evaporator, such that the on/off operations of the heater can be controlled according to a temperature detected by the corresponding evaporator temperature sensor.

In accordance with the related art, as the temperature detected by the evaporator temperature sensor gradually increases during the defrosting process, the operation time of the heater is gradually reduced. In more detail, the pattern of the heater (i.e., the starting and stopping of the heater) is controlled according to a temperature detected by the evaporator temperature sensor.

However, according to the related art, the heater is controlled according to a predetermined pattern and a time needed to finish defrosting is elongated, such that there is a high probability that the inner temperature of the refrigerator increases during the defrosting process. Therefore, there is a high possibility that foods stored in the refrigerator become rotten.

In addition, if the remaining frost is present after completion of the defrosting operation, or if frost is concentrated only at a specific part of the inner space of the refrigerator, there is a need to maintain the output of the heater at a predetermined level or higher so as to remove the remaining frost. However, since a conventional refrigerator according to the related art controls the output of the heater using a specific pattern, the defrosting process is interrupted although the defrosting process needs to be continuously performed, such that a necessary heater output may be unavoidably reduced.

A conventional refrigerator according to another related art includes a freezing evaporator and a refrigerating evaporator connected in series, a first defrosting heater to heat the freezing evaporator, and a second defrosting heater to heat the refrigerating evaporator. In the above-mentioned conventional refrigerator, the freezing evaporator is generally located above the refrigerating evaporator, and each defrosting heater is located below each evaporator.

However, the freezing evaporator is located above the refrigerating evaporator according to the above-mentioned structure. In order to perform overall defrosting using the freezing evaporator, the first defrosting heater must be continuously driven while heat generated from the first defrosting heater is transferred in an upward direction of the freezing evaporator, such that the inner temperature of the freezing chamber unavoidably increases.

Therefore, various embodiments of the present disclosure are directed to providing a refrigerator that substantially obviates one or more problems due to limitations and disadvantages of the related art. The embodiments of the present disclosure can more efficiently perform the defrosting process so as to prevent the inner temperature of the freezing chamber from increasing. The structure and features of the refrigerator according to the present disclosure will hereinafter be described with reference to the attached drawings.

Referring to FIG. 1, the refrigerator 100 according to one embodiment may include a cooling cycle composed of a compressor 2, a condenser 3, a refrigerating evaporator 4, and a freezing evaporator 5.

A first capillary tube 6 acting as a decompressor may be located above a flow passage connected to the freezing evaporator 5. In addition, the refrigerating evaporator 4 may be installed in a branch flow passage disposed between the condenser 3 and the first capillary tube 6, and a second capillary tube 7 acting as a decompressor may be disposed between the corresponding branch point and the refrigerating evaporator 4.

A lower part of the flow passage connected to the refrigerating evaporator 4 may be connected to the flow passage disposed between the first capillary tube 6 and the freezing evaporator 5.

A flow passage switching valve 8 for switching the supply state of a refrigerant flowing to the refrigerating evaporator 4 and the freezing evaporator 5 is disposed at the branch point. The flow passage switching valve 8 according to the present disclosure may be implemented as a switching valve such as a three-way valve.

The flow passage switching valve 8 may include a port configured to control whether to move the refrigerant, and may include a port for switching the flow of refrigerant to the condenser, a port for switching the flow of refrigerant to the refrigerating evaporator 4, and a port for switching the flow of refrigerant to the freezing evaporator 5. In addition, the flow passage switching valve 8 may be controlled by the controller C.

The flow passage switching valve 8 may be controlled under the following three conditions by the controller C. Under the first condition, the flow passage switching valve 8 may allow the refrigerant to flow in both the refrigerating evaporator 4 and the freezing evaporator 5. Under the second condition, the flow passage switching valve 8 may prevent the refrigerant from flowing to the refrigerating evaporator 4 and may allow the refrigerant to flow only in the freezing evaporator 5. Under the third condition, the flow passage switching valve 8 may prevent the refrigerant from flowing to both the freezing evaporator 5 and the refrigerating evaporator 4.

Figure 2:
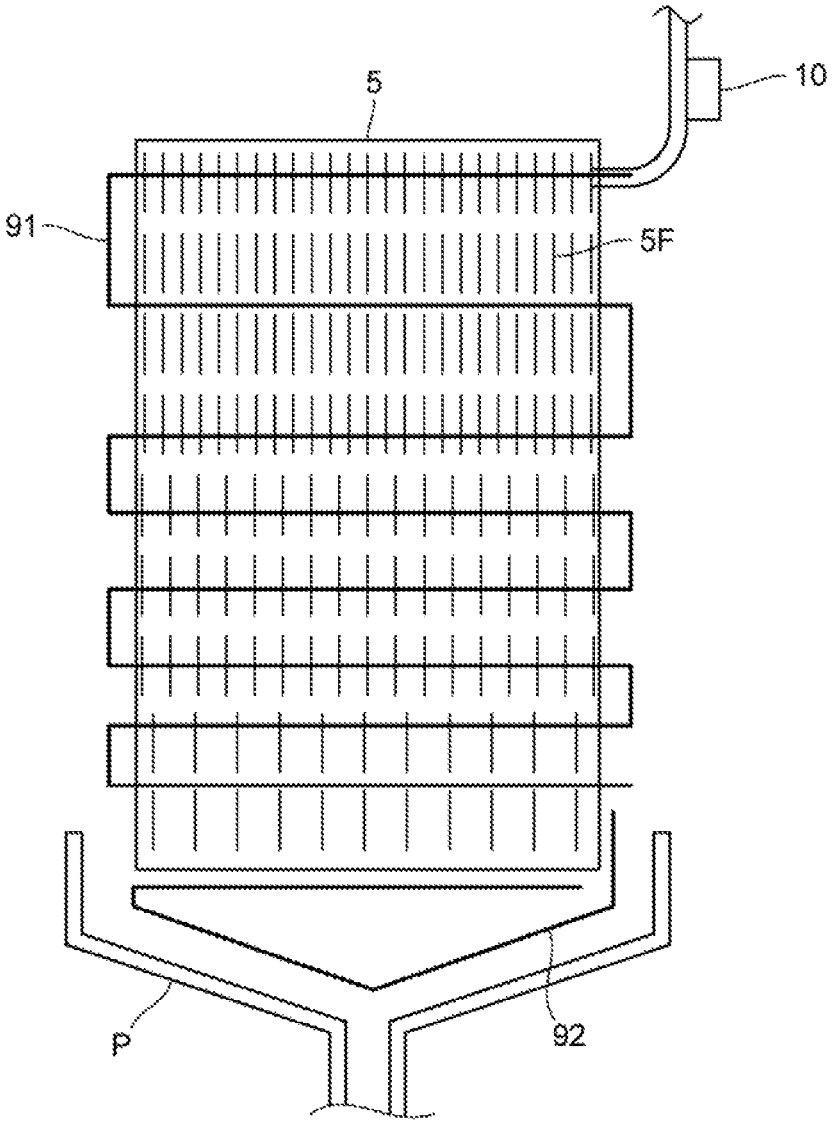
FIG. 2 is a conceptual diagram illustrating an arrangement format of an evaporator, an upper heater, and a lower heater according to an embodiment of the present disclosure.

In addition, as shown in FIG. 2, a plurality of heaters (91, 92) for removing frost formed at each of the evaporators 4 and 5 may be mounted to the refrigerating evaporator 4 and the freezing evaporator 5. In more detail, an upper heater 91 and a lower heater 92 may be mounted to the freezing evaporator 5. In addition, the upper heater 91 and the lower heater 92 may be controlled by the controller C.

The upper heater 91 may be arranged according to a pitch of fins (5F) of the freezing evaporator 5. In more detail, the upper heater 91 may be arranged in a different way from the arrangement direction of the fin pitch. In addition, an upper part of the fin pitch of the freezing evaporator 5 is small in width, and a lower part of the fin pitch of the freezing evaporator 5 is large in width, such that the upper heater 91 may be arranged in a horizontal winding pattern such that the upper part of the upper heater 91 is large in width and the lower part of the upper heater 91 is small in width.

In addition, the lower heater 92 may be arranged below the upper heater 91 of the freezing evaporator 5. In more detail, the lower heater 92 may be arranged along the bottom surface of the freezing evaporator 5, and may be arranged along the bottom surface of a drain fan installed below the freezing evaporator 5.

An evaporator temperature sensor 10 for measuring a temperature of the outer surface of the corresponding freezing evaporator 5 may be mounted to the freezing evaporator 5. The evaporator temperature sensor 10 may be installed to a refrigerant pipe of the freezing evaporator 5. The measured evaporator temperature may be transferred to the controller C.

The operation principles of the other refrigerant 100 according to one embodiment will hereinafter be described with reference to FIG. 3.

If a freezing temperature zone (i.e., the freezing chamber) is cooled according to a general cooling operation, the controller C may open the freezing-chamber port of the flow passage switching valve 8 and may close the refrigerating-chamber port of the flow passage switching valve 8, so as to allow the refrigerant to flow in the freezing evaporator 5.

In contrast, if a refrigerating temperature zone (i.e., the refrigerating chamber) is cooled, the controller C may open the refrigerating-chamber port of the flow passage switching valve 8 and may close the freezing-chamber port of the flow passage switching valve 8, so as to allow the refrigerant to flow in the refrigerating evaporator 4.

If the operation mode of the refrigerator is switched from a general cooling mode to the defrosting mode, the controller C may open the refrigerating-chamber port of the flow passage switching valve 8. In this case, although the refrigerating-chamber port may be opened or closed without any problem, it is more desirable that the refrigerating-chamber port be opened to remove a pressure difference between a suction part and a discharge part of the compressor 2.

In addition, the above-mentioned switching to the defrosting mode may begin when the controller C determines that the temperature D measured by the evaporator temperature sensor 10 is identical to a predetermined defrosting start temperature (e.g., −10° C.).

In addition, when the operation mode switches to the defrosting mode, the controller C may control the output of the upper heater 91 and the output of the lower heater 92.

In more detail, the output level of the upper heater 91 and the output level of the lower heater 92 maximally increase to 100% so as to quickly remove frost attached to the evaporator, such that the frost attached to the freezing evaporator 5 can be melted and removed.

After the beginning of the defrosting mode, if a temperature measured by the temperature sensor 10 reaches a first temperature ($T_1$) this means that change of latent heat is completed, such that the freezing-chamber port of the flow passage switching valve 8 is closed to prevent refrigerant from flowing to the freezing evaporator 5. In addition, the controller C may simultaneously control the output levels of the upper heater 91 and the lower heater 92.

Generally, the first temperature may refer to a temperature at which the change of latent heat is ended. Although the first temperature according to the present disclosure may range from 0° C. to 1° C. for convenience of description, the scope or spirit of the present disclosure is not limited thereto.

The controller C may simultaneously control the output of the upper heater 91 and the output of the lower heater 92, or may separately or independently control the output of the upper heater 91 and the output of the lower heater 92 at different time points.

Thereafter, if the temperature measured by the evaporator temperature sensor 10 reaches a second temperature ($T_2$), the controller C may determine completion of the defrosting process and may stop the output of the upper heater 91 and the lower heater 92.

Generally, the second temperature may refer to a temperature at which no more frost is formed at the evaporator. Although the second temperature according to the present disclosure may range from 8° C. to 12° C. for convenience of description, the scope or spirit of the present disclosure is not limited thereto.

If the defrosting process is completed, the controller C may restart the common cooling operation.

In the above-mentioned refrigerator 100 according to the first embodiment, the refrigerant supply state may be switched by the flow passage switching valve 8 on the basis of the temperature detected by the evaporator temperature sensor 10, and at the same time the output of the upper heater 91 and the output of the lower heater 92 may be controlled in a stepwise manner. As a result, the defrosting operation time can be reduced and the increase of the inner temperature of the refrigerator can be prevented.

In more detail, if the measured temperature is less than the first temperature ($T_1$), the refrigerant flows to the freezing evaporator 5, and at the same time the output of the upper heater 91 and the output of the lower heater 92 can be maximized, such that the defrosting operation time for removing frost of the freezing evaporator 5 may be reduced.

In addition, if the measured temperature is equal to or higher than the first temperature ($T_1$), the refrigerant does not flow in the freezing evaporator 5, and the output of the upper heater 91 and the output of the lower heater 92 can be controlled, such that temperature overshoot of the freezing evaporator is suppressed and increase of the inner temperature of the refrigerator can also be suppressed.

Figure 5:
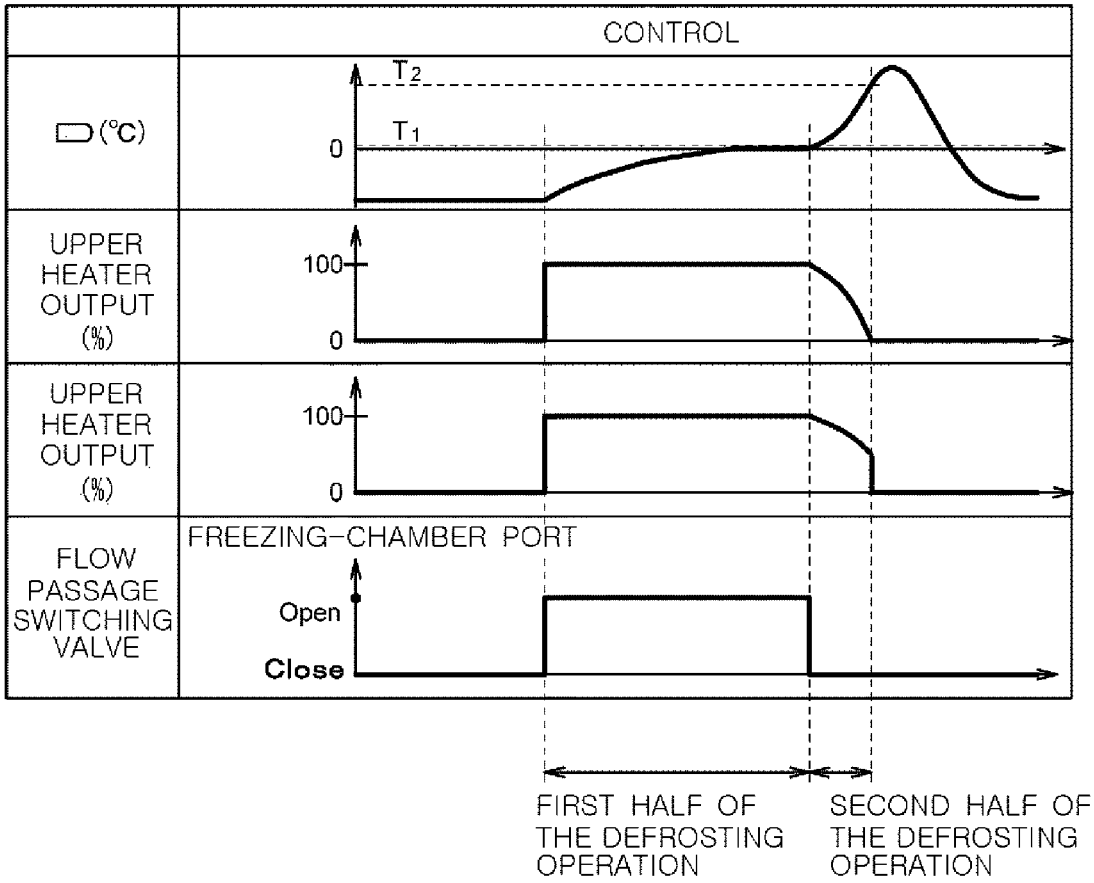
FIG. 5 is a conceptual diagram illustrating a method for controlling flow passage switching valves and heaters according to temperature change during the defrosting operation according to a second embodiment of the present disclosure.

A refrigerator 100 according to a second embodiment of the present disclosure will hereinafter be described with reference to FIGS. 4 and 5.

Although the refrigerator 100 according to the second embodiment includes the same constituent elements as those of the refrigerator 100 of the first embodiment, control content of the defrosting operation of the second embodiment is different from that of the first embodiment.

If the operation mode is switched from the common cooling operation to the defrosting operation, the controller C may open the freezing-chamber port of the flow passage switching valve 8. In addition, it does not matter whether the refrigerating-chamber port is opened or closed. However, in order to remove a pressure difference between the suction part and the discharge part of the compressor 2, it may be more preferable that the refrigerating-chamber port be opened.

The controller C may drive the upper heater 91 and the lower heater 92 so that the output levels of the upper heater 91 and the lower heater 92 may be maximized to 100%.

After the beginning of the defrosting operation, if a temperature measured by the temperature sensor 10 reaches a first temperature ($T_1$), this means that change of latent heat is completed, such that the freezing-chamber port of the flow passage switching valve 8 is closed in a manner that refrigerant does not flow in the freezing evaporator 5.

The controller C may simultaneously drive the upper heater 91 and the lower heater 92 so that the output levels of the upper heater 91 and the lower heater 92 may be controlled according to the following output control functions (1) and (2).

Output control function of Upper Heater 91: $100-100\times(D-T_1)/(T_2-D)$ (1)

Output control function of Lower Heater 92: $100-100\times(D-T_1)/(X\times T_2-D)$ (2)

In the above functions (1) and (2), D may denote a temperature detected by the evaporator temperature sensor 10.

$T_1$ may denote a first decision temperature. For convenience of description and better understanding of the present disclosure, the first decision temperature ($T_1$) may be exemplarily set to 0.5° C. $T_2$ may denote a second decision temperature. For convenience of description and better understanding of the present disclosure, the second decision temperature ($T_2$) may be exemplarily set to 10° C.

X is a coefficient by which the output of the lower heater 92 becomes higher than the output of the upper heater 91. If X is set to 2(i.e., X=2), the output of the lower heater 92 may reach the output level of 50% just before the defrosting operation is completed at the second decision temperature ($T_2$).

The controller C may simultaneously control the output of the upper heater 91 and the output of the lower heater 92, may allocate different times and different sizes (or levels) to the output of the upper heater 91 and the output of the lower heater 92, and may control the output of the upper heater 91 and the output of the lower heater 92 independently of each other.

Thereafter, if the temperature measured by the evaporator temperature sensor 10 reaches the second temperature ($T_2$), the controller C may determine that the defrosting process is completed and may stop the output of the upper and lower heaters 91 and 92.

Generally, although the second temperature is a temperature at which no more frost is formed at the evaporator, the second temperature of the present disclosure may exemplarily range from 8° C. to 12° C. for convenience of description, and the scope or spirit of the present disclosure is not limited thereto.

If the defrosting process is completed, the controller C may restart the common cooling operation.

The refrigerator 100 of the second embodiment may have the same effects as those of the first embodiment, and may prevent the lower part of the freezing evaporator 5 or the drain fan from being re-frosted by water or ice dropped from the upper part of the freezing evaporator 5 during the defrosting operation.

Figure 6:
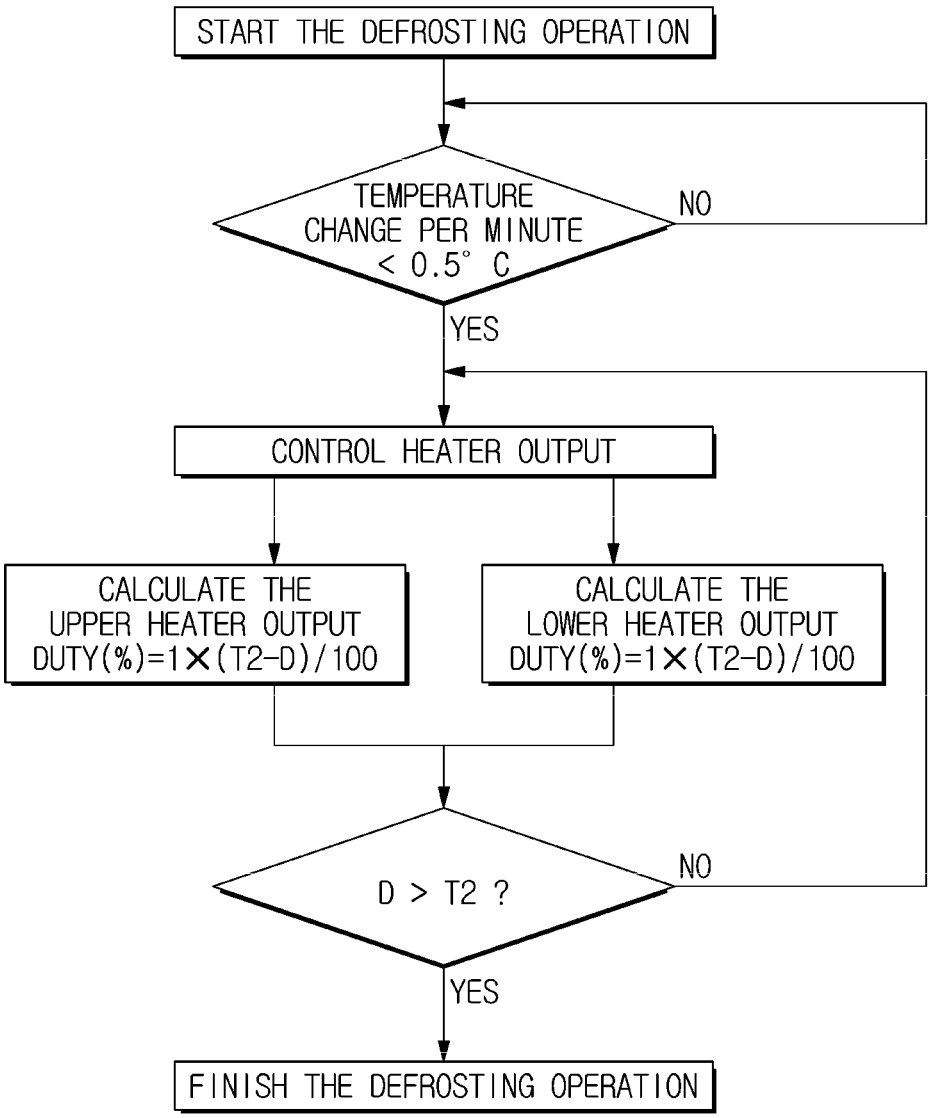
FIG. 6 is a flowchart illustrating a method for controlling the defrosting operation according to a third embodiment of the present disclosure.
Figure 7:
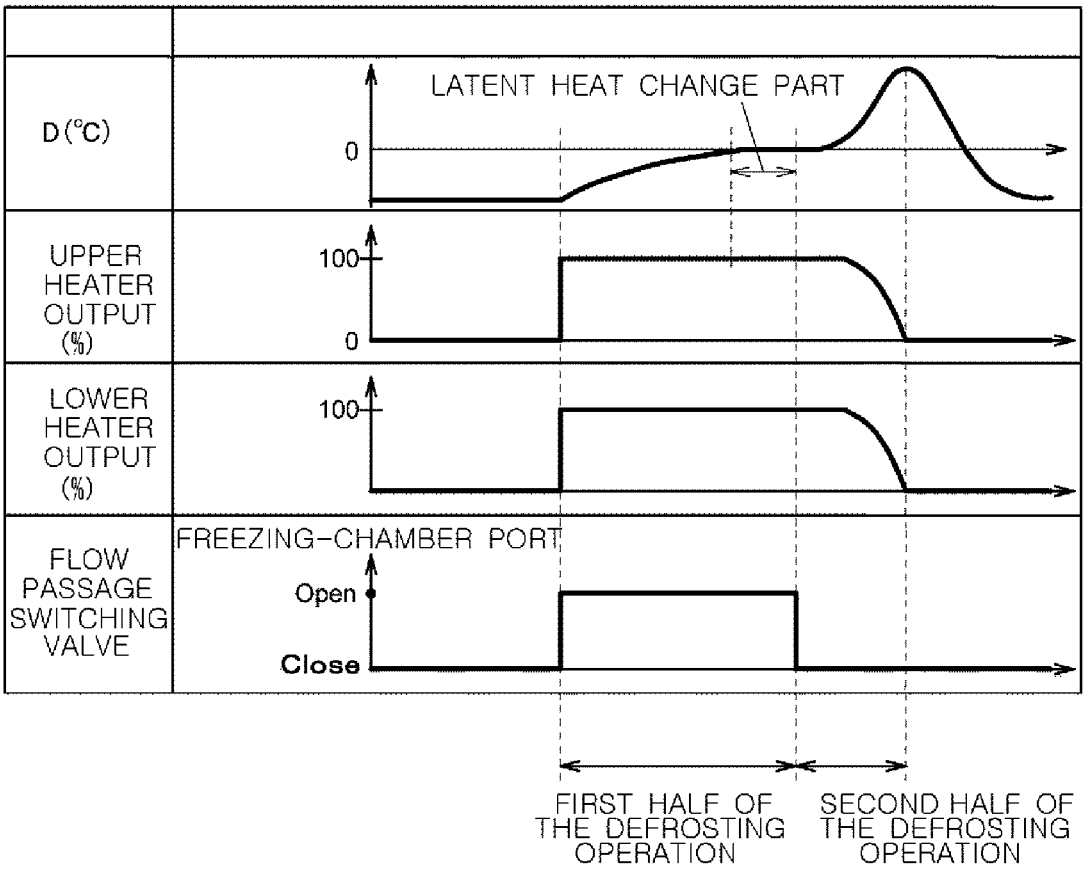
FIG. 7 is a flowchart illustrating a method for controlling flow passage switching valves and heaters according to a temperature change during the defrosting operation according to a third embodiment of the present disclosure.

The refrigerator 100 of the third embodiment will hereinafter be described with reference to FIGS. 6 and 7.

Although the constituent elements of the refrigerator 100 according to the third embodiment are identical to those of the first embodiment, control content of the refrigerator 100 of the third embodiment is different from that of the first embodiment.

If the operation mode is switched from the common cooling operation mode to the defrosting mode, the controller C may open the freezing-chamber port of the flow passage switching valve 8. In addition, it does not matter whether the refrigerating-chamber port is opened or closed. However, in order to remove a pressure difference between the suction part and the discharge part of the compressor 2, it may be more preferable that the refrigerating-chamber port be opened.

The controller C may operate the upper heater 91 and the lower heater 92 to maximize the output of the upper heater 91 and the output of the lower heater 92.

After the beginning of the defrosting process, if a temperature change value per unit time of the measured temperature D is lower than a predetermined change value on the basis of the measurement value of the evaporator temperature sensor 10, the freezing-chamber port of the flow passage switching valve 8 is closed to prevent refrigerant from flowing in the freezing evaporator 5, and at the same time the output of the upper heater 91 and the lower heater 92 can be controlled by the controller C.

Thereafter, if the temperature change value per unit time of the measured temperature D is lower than the predetermined change value, the controller C may determine completion of latent heat change, and may close the freezing-chamber port of the flow passage switching valve 8, such that the refrigerant does not flow in the freezing evaporator 5. The controller C may control the output of the upper heater 91 and the lower heater 92 in a stepwise manner.

The above-mentioned predetermined change value may indicate a measurement value obtained when the region of latent heat changed in a time variation zone of the measured temperature is measured. For example, assuming that a time variation per minute in the measured temperature is 0.5° C. or less, the controller C of the present disclosure may determine that the predetermined change value is identical to 0.5° C. or less. However, the scope or spirit of the present disclosure is not limited thereto.

After that, if the temperature measured by the evaporator temperature sensor 10 reaches the second temperature ($T_2$), the controller C may determine completion of the defrosting process and may thus stop the upper heater 91 and the lower heater 92.

Generally, the second temperature may refer to a temperature at which no more frost is formed at the evaporator. Although the second temperature may range from 8° C. to 12° C. for convenience of description, the scope or spirit of the present disclosure is not limited thereto.

After completion of the defrosting process, the controller C may restart the common cooling operation.

The refrigerator 100 of the third embodiment may have the same effects as those of the first embodiment, and may further flow the refrigerant to the freezing evaporator 5 in consideration of a latent heat region of ice formed at the freezing evaporator 5, such that the defrosting time of the freezing evaporator 5 can be greatly reduced.

Since the defrosting process is performed in a stepwise manner according to temperature change, negative influence caused by measurement error of the evaporator temperature sensor 10 can be greatly reduced.

In addition, the upper heater and the lower heater 92 are controlled according to the same output variable control scheme, such that a control circuit can be simplified in structure and the costs of the control circuit can be reduced.

A refrigerator according to a fourth embodiment of the present disclosure will hereinafter be described with reference to FIGS. 8 to 10.

Figure 8:
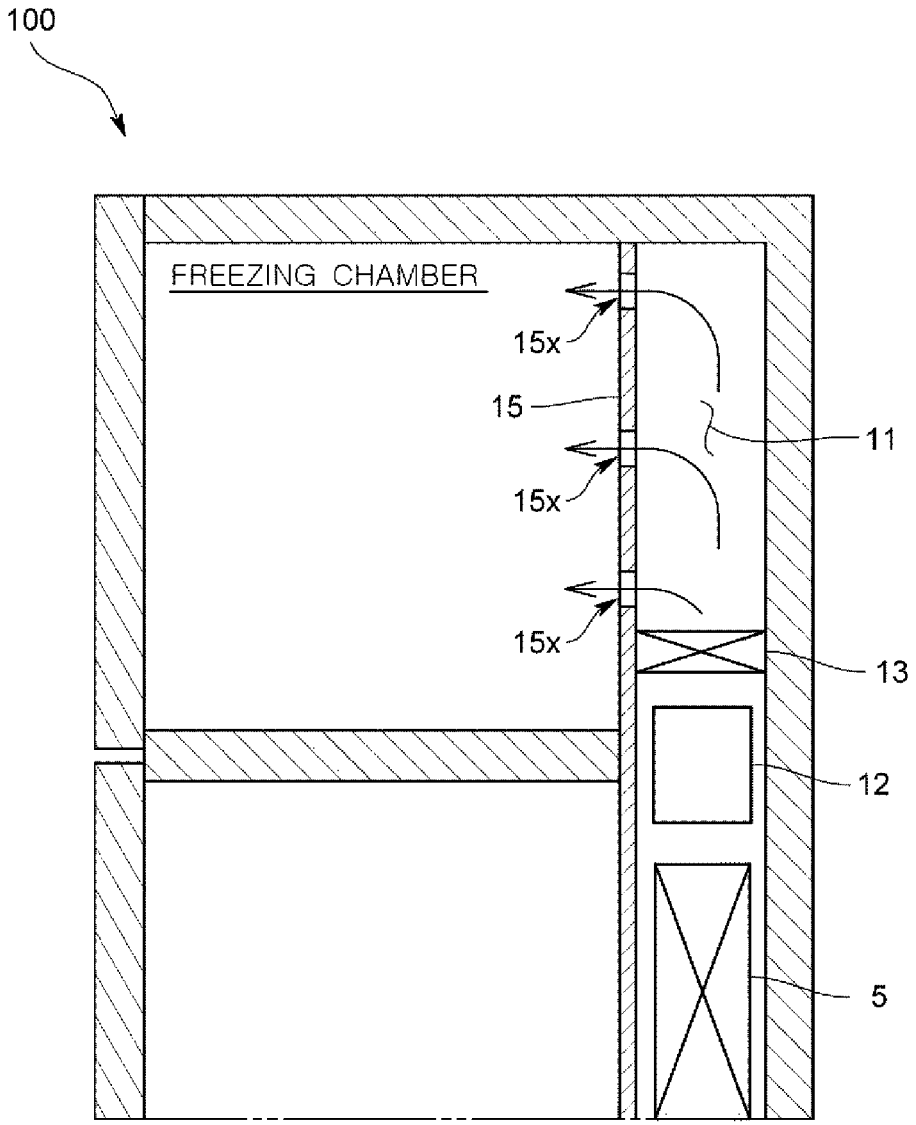
FIG. 8 is a conceptual diagram illustrating appearance of an air passage according to a fourth embodiment of the present disclosure.

Referring to FIG. 8, the refrigerator 100 according to the fourth embodiment may include a freezing evaporator 5; and an air passage 11 through which cold air generated from the freezing evaporator 5 flows in the storage chamber. The air passage 11 may include a blower fan 12 through which cold air is introduced into the storage chamber; a trap part 14 in which warm air generated by the defrosting operation is trapped; and an opening/closing damper 13 for controlling movement of the cold air.

The refrigerator according to the fourth embodiment need not always include a plurality of evaporators, and may include only one evaporator as necessary.

The trap part 14 may be formed in a cover frame 15 installed above the freezing evaporator 5.

The cover frame 15 may be configured to form some parts of the air passage 11, or may be an inner-surface cover frame configured to form the inner surface of the freezing chamber.

Figure 9:
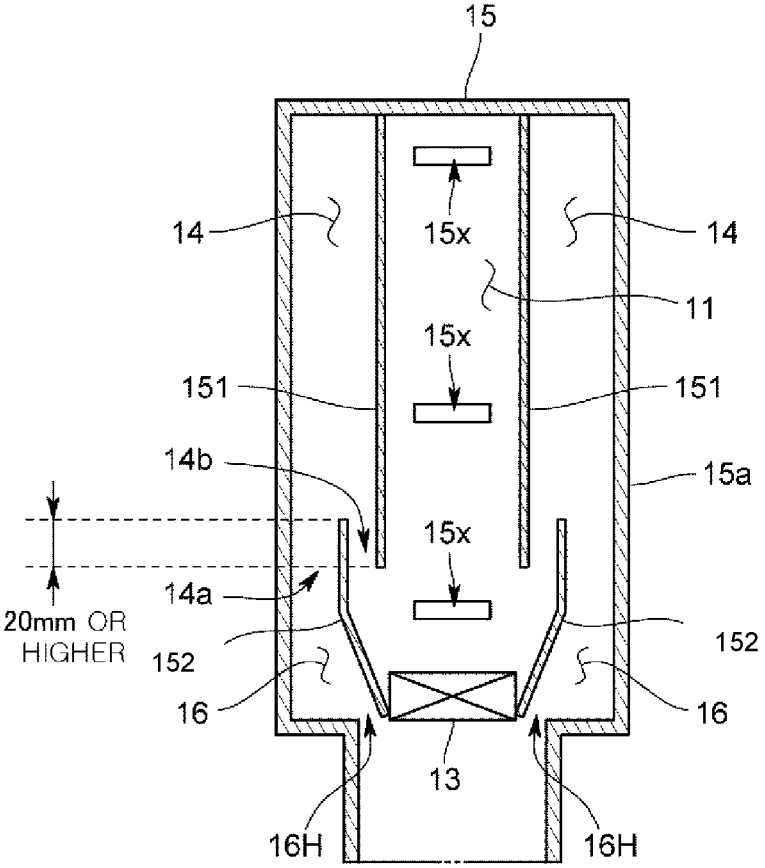
FIG. 9 is a conceptual diagram illustrating a trap part installed in an air passage according to a fourth embodiment of the present disclosure.
Figure 10:
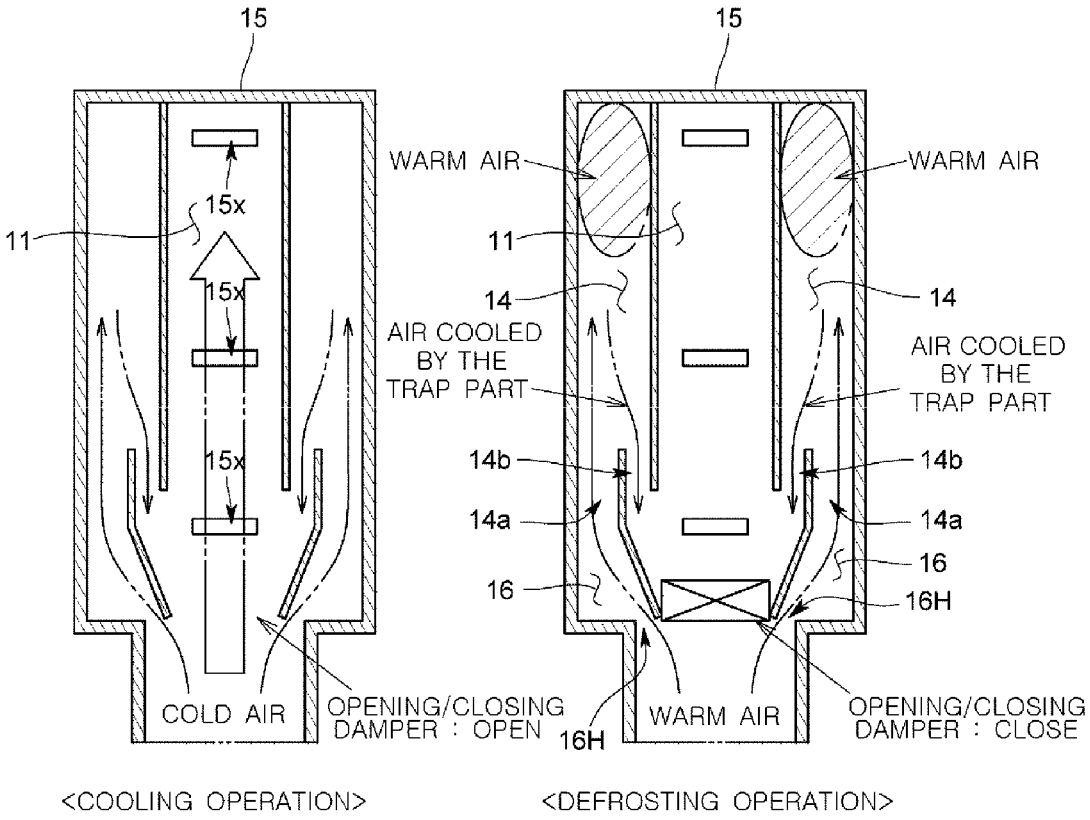
FIG. 10 is a conceptual diagram illustrating flow of air according to a fourth embodiment of the present disclosure.

In more detail, as shown in FIG. 9, the cover frame 15 may include a plurality of spray parts 15*x* intermittently formed in a vertical direction so as to spray cold air to the inside of the refrigerator (i.e., the inner space of the refrigerating chamber). Each spray part 15*x* may be implemented as a single opening (or aperture) forming a rectangular shape.

The cover frame 15 may include two partition parts 151 respectively formed at both sides of the plurality of spray parts 15*x*. The space between the two partition parts 151 may be some parts of the air passage 11.

The space formed at both sides (i.e., the left and right sides) of the two partition parts 151 may be the trap part 14 in which warm air generated by the defrosting operation is trapped. In more detail, the trap part 14 may be formed between the outer wall 15*a* of the cover frame 15 and the partition parts 151.

The opening/closing damper 13 may be located below two partition parts 151 formed in the cover frame 15. If the opening/closing damper 13 is opened, an air passage 11 formed in the cover frame 15 is opened, such that air may flow in a downward direction through the air passage 11.

Differently from the above case in which the air passage 11 is closed when the opening/closing damper 13 is closed, the air may not flow in the upward direction through the air passage 11.

However, if the opening/closing damper 13 is closed, a guide part 152 and a guide passage 16 through which the air generated from the freezing evaporator 5 can be introduced into the trap part 14 may be formed.

The guide passage 16 through which the refrigerant passes may be formed at the outside of the guide part 152. In addition, the guide passage 16 may be formed by the guide part 152 formed in the cover frame 15.

The lower end of the guide part 152 may contact the opening/closing damper 13 without formation of a gap. An opening part 16H of the guide passage 16 may be formed between the outer walls 15*a* of the corresponding guide part 152.

In order to introduce warm air generated by the defrosting operation into the trap part 14, the opening part 16H may be formed at the left and right sides of the opening/closing damper 13, and may have a width of 10 mm or higher.

The upper end of the guide part 152 may be located between the partition part 151 and the outer wall 15*a*, such that an inlet 14*a* and an outlet 14*b* may be formed in the trap part 14.

That is, the space located at the outside of the guide part 152 may be used as the inlet 14*a* of the air having passed through the guide passage 16, and the space located at the inside of the guide part 152 may be used as the outlet 14*b* of the air having passed through the trap part 14. The outlet 14*b* may be connected to the air passage 11.

In order to prevent warm air received from the inlet 14*a* of the trap part 14 from flowing in the upward direction as well as to prevent warm air leakage from the outlet 14*b*, the upper end of the guide part 152 may be located at the lower end of the trap part 14, i.e., the upper end of the guide part 152 may be located at a specific position higher than the lower end of the partition part 151 by a predetermined distance of 20 mm or higher. In addition, a cross-sectional region of each trap part 14 may be identical to ½ or less of the cross-sectional region of the air passage 11.

The above-mentioned embodiment has disclosed the refrigerator 100 of the fourth embodiment with reference to FIGS. 8 and 9. The air flow generated in the defrosting operation of the fourth embodiment will hereinafter be described with reference to FIG. 10.

During the common cooling operation, the opening/closing damper 13 is opened. As a result, cold air generated by the freezing evaporator 5 may pass through the air passage 11 through the blower fan 12, and may be introduced into the freezing evaporator after passing through the plurality of spray parts 15*x*.

However, if the heaters (91, 92) start operation according to the defrosting operation, the opening/closing damper 13 may be closed. In this case, warm air heated by the heaters (91, 92) mounted to the freezing evaporator 5 may arrive at the opening/closing damper 13 through the air passage 11.

Since the opening/closing damper 13 is closed, the warm air may not pass through the opening/closing damper 13, may move through the opening part 16H formed at both sides (i.e., the left and right sides) of the opening/closing damper 13, and may flow into the trap part 14 through the guide passage 16. Due to the above-mentioned structural characteristics, warm air generated by the defrosting operation may stay in the trap part 14, and may not be introduced into the inside (i.e., the inner space of the freezing evaporator) of the refrigerator.

In addition, since the inlet 14*a* and the outlet 14*b* of the trap part 14 are formed separately from each other, the initially introduced warm air may be cooled by peripheral cold air and may move downward so that the warm air may flow from the outlet 14*b* to the air passage 11.

The newly introduced warm air may also stay in the trap part 14 and may then be cooled according to the same mechanism.

Thereafter, since the heaters (91, 92) stop operation after completion of the defrosting process, the controller C may open the opening/closing damper 13. Therefore, cold air generated by the freezing evaporator 5 may be introduced into the freezing evaporator without passing through the trap part 14, such that the common cooling operation may begin.

The above-mentioned refrigerator 100 of the fourth embodiment includes the trap part 14 in which warm air generated by the defrosting process is trapped, such that the refrigerator 100 can prevent the warm air generated by the defrosting process from being introduced into the inner space of the storage chambers through the air passage 11.

In addition, if the opening/closing damper 13 is disposed between the blower fan 12 and the trap part 14 and the opening/closing damper 13 is closed, warm air generated by the defrosting operation can be easily introduced into the trap part 14 because the guide passage 16 through which the warm air is introduced into the trap part 14 is present. In addition, the refrigerator 100 can more efficiently prevent the warm air from being introduced into the inside of the refrigerator through the air passage 11.

In addition, the trap part 14 may include a heat storage material or a cooling material to cool warm air. In this case, the warm air can be cooled, so that it can efficiently prevent the warm air from being introduced into the inner space of the refrigerator through the air passage 11.

In accordance with the present disclosure, if the opening/closing damper 13 is opened, the guide part 152 and the guide passage 16 may be closed. In this case, cold air is introduced into the trap part 14 during the common cooling operation, such that the cooling efficiency of the inner space of the refrigerator is not deteriorated.

In addition, according to the fourth embodiment, the opening/closing damper 13 may differentially control the opening degree thereof according to the operation state of the refrigerator.

In more detail, during the defrosting operation, the controller C may completely close the opening/closing damper 13. During the freezing mode (for example, the case in which the inner temperature of the refrigerator is set to −18° C.) of the cooling operation, the controller C may completely open the opening/closing damper 13. During a thawing mode (for example, the case in which the inner temperature of the refrigerator is set to −1° C. to 5° C.) of the cooling operation, the controller C may semi-open the opening/closing damper 13 such that the opening/closing damper 13 is opened with a semi-opened state disposed between the completely opened state and the completely closed state.

Figure 11:
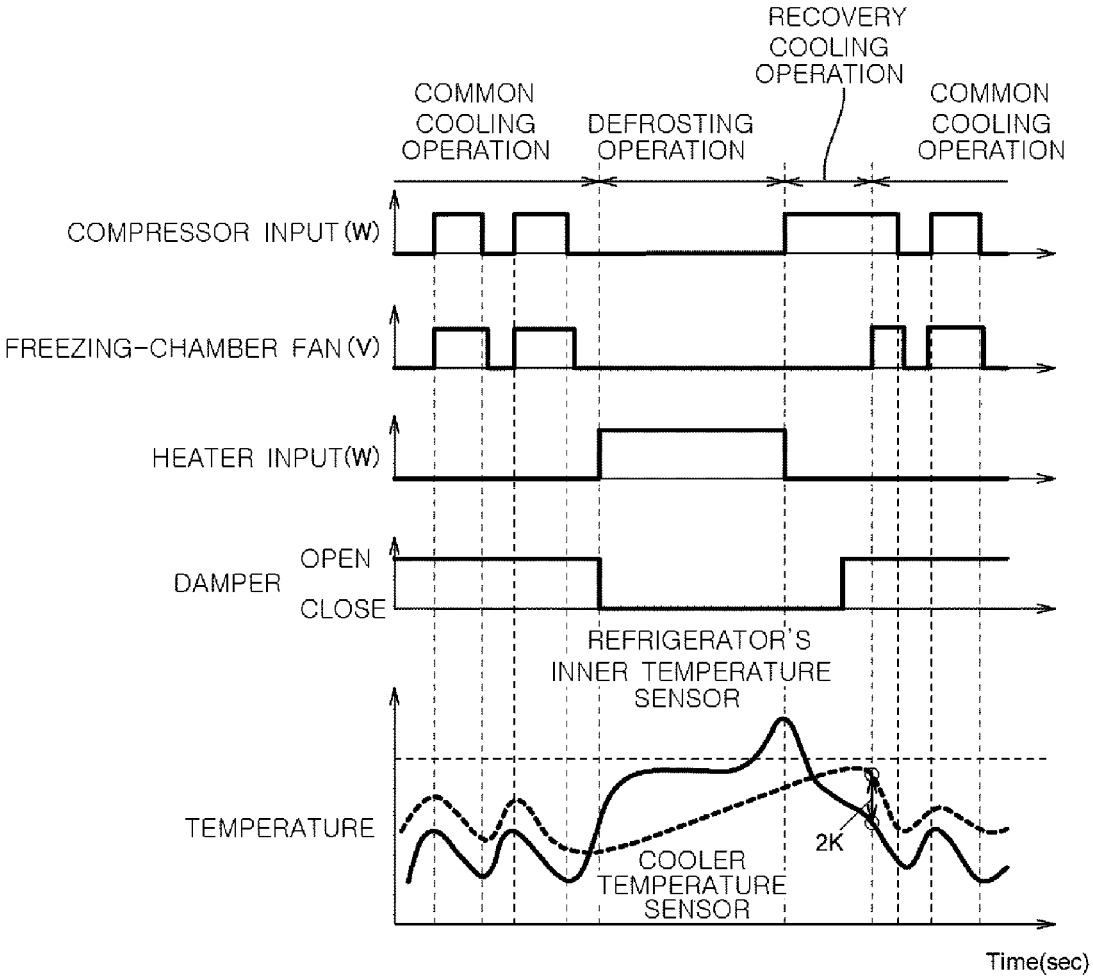
FIG. 11 is a conceptual diagram illustrating a method for controlling respective constituent elements of the refrigerator according to a fifth embodiment of the present disclosure.

A refrigerator 100 according to a fifth embodiment of the present disclosure will hereinafter be described with reference to FIG. 11.

The refrigerator 100 according to the fifth embodiment relates to a method for controlling the refrigerator disclosed in the fourth embodiment.

In more detail, the controller C may control the operation of the blower fan 12 and the opening or closing of the opening/closing damper 13 according to a temperature detected by the inner temperature sensor (not shown) installed in the freezing chamber and the temperature detected by the evaporator temperature sensor 10.

After completion of the defrosting operation, if a difference between the temperature detected by the inner temperature sensor of the refrigerator and the temperature detected by the evaporator temperature sensor 10 satisfies a predetermined value (e.g., 2° C. or higher), the controller C may drive the blower fan 12.

In this case, the controller C may continuously open the opening/closing damper 13 until the blower fan 12 restarts operation after the operation of the heaters (91, 92) was completed.

In addition, irrespective of the temperature detected by the inner temperature sensor of the refrigerator and the temperature detected by the evaporator temperature sensor 10, the controller C may control the blower fan 12 to start operation after lapse of a predetermined time upon completion of the defrosting operation.

Control content of respective operations (e.g., a cooling operation, a defrosting operation, etc.) according to a fifth embodiment of the present disclosure will hereinafter be described.

During the common cooling operation, the controller C may control whether to operate the compressor 2 and the blower fan 12 on the basis of the temperature detected by the inner temperature sensor of the refrigerator. If the temperature detected by the evaporator temperature sensor 10 reaches a predetermined defrosting start temperature (e.g., −10° C.), the controller C may start the defrosting operation.

During the defrosting operation, the controller C may stop the compressor 2 and the blower fan 12, may drive the heaters (91, 92), and may open the opening/closing damper 13. The remaining control content may be identical to those of the above-mentioned embodiments.

If the temperature D detected by the evaporator temperature sensor 10 reaches a predetermined defrosting stop temperature (e.g., −10° C.), the controller C may stop the defrosting operation by stopping the heaters (91, 92).

After completion of the defrosting operation, the controller C may start a recovery cooling operation by driving the compressor 2.

During the recovery cooling operation, the controller C may operate the blower fan 12 when a difference between the temperature measured by the inner temperature sensor of the refrigerator and the temperature measured by the evaporator temperature sensor 10 is set to 2° C. or higher.

After lapse of a predetermined time after the beginning of the recovery cooling operation, the controller C may open the opening/closing damper 13. In addition, the predetermined time may be set to a specific time to be consumed until a difference between the temperature detected by the inner temperature sensor of the refrigerator and the temperature detected by the evaporator temperature sensor 10 is set to 2° C. or higher. However, the scope or spirit of the present disclosure is not limited thereto.

After the blower fan 12 starts operation according to the recovery cooling operation, the controller C may start the common cooling operation.

In accordance with the above-mentioned refrigerator 100 of the fifth embodiment, after completion of the defrosting operation, if a difference between the temperature detected by the inner temperature sensor of the refrigerator and the temperature detected by the evaporator temperature sensor 10 is set to 2° C. or higher, the blower fan 12 starts operation after the temperature of the evaporator 5 is lowered, such that warm air is prevented from flowing into the refrigerating chamber, resulting in increased efficiency of the refrigerator.

In addition, the controller C may control the opening/closing damper 13 to be opened before the blower fan 12 starts operation after completion of the defrosting operation, such that the controller C can prevent the opening/closing damper 13 from being cooled and frozen by cold air, and can also prevent occurrence of a malfunction or faulty operation of the opening/closing damper 13.

The scope or spirit of the present disclosure is not limited thereto, and may be modified in various ways.

For example, although the above-mentioned embodiment has disclosed that 2 heaters are mounted to the freezing evaporator 5 for convenience of description, three or more heaters may also be mounted to the freezing evaporator 5 as necessary.

In addition, the plurality of heaters according to the present disclosure may be arranged in a vertical direction, and may also be arranged in a horizontal direction as necessary.

As previously disclosed in the above-mentioned embodiments, if the temperature measured by the temperature sensor 10 reaches the first temperature, the refrigerant supply state is switched by the flow passage switching valve 8 and at the same time the heater control is also switched by the flow passage switching valve 8. However, the refrigerant supply state switching and the heater control switching using the flow passage switching valve 8 may be performed at the same time or at different times.

In addition, the present disclosure may be applied not only to the case in which the refrigerating evaporator 4 and the freezing evaporator 5 are arranged in series, but also to the other case in which the refrigerating evaporator 4 and the freezing evaporator 5 are arranged in parallel.

Although the above-mentioned embodiments have disclosed that two evaporators (i.e., the refrigerating evaporator and the freezing evaporator) are mounted to the refrigerator for convenience of description, three or more evaporators may also be mounted to the refrigerator as necessary. In contrast, according to the respective embodiments, the number of heaters mounted to the freezing evaporator 5 may also be set to 1 without departing from the scope or spirit of the present disclosure.

A refrigerator according to a sixth embodiment of the present disclosure will hereinafter be described with reference to FIGS. 12 to 14.

Figure 12:
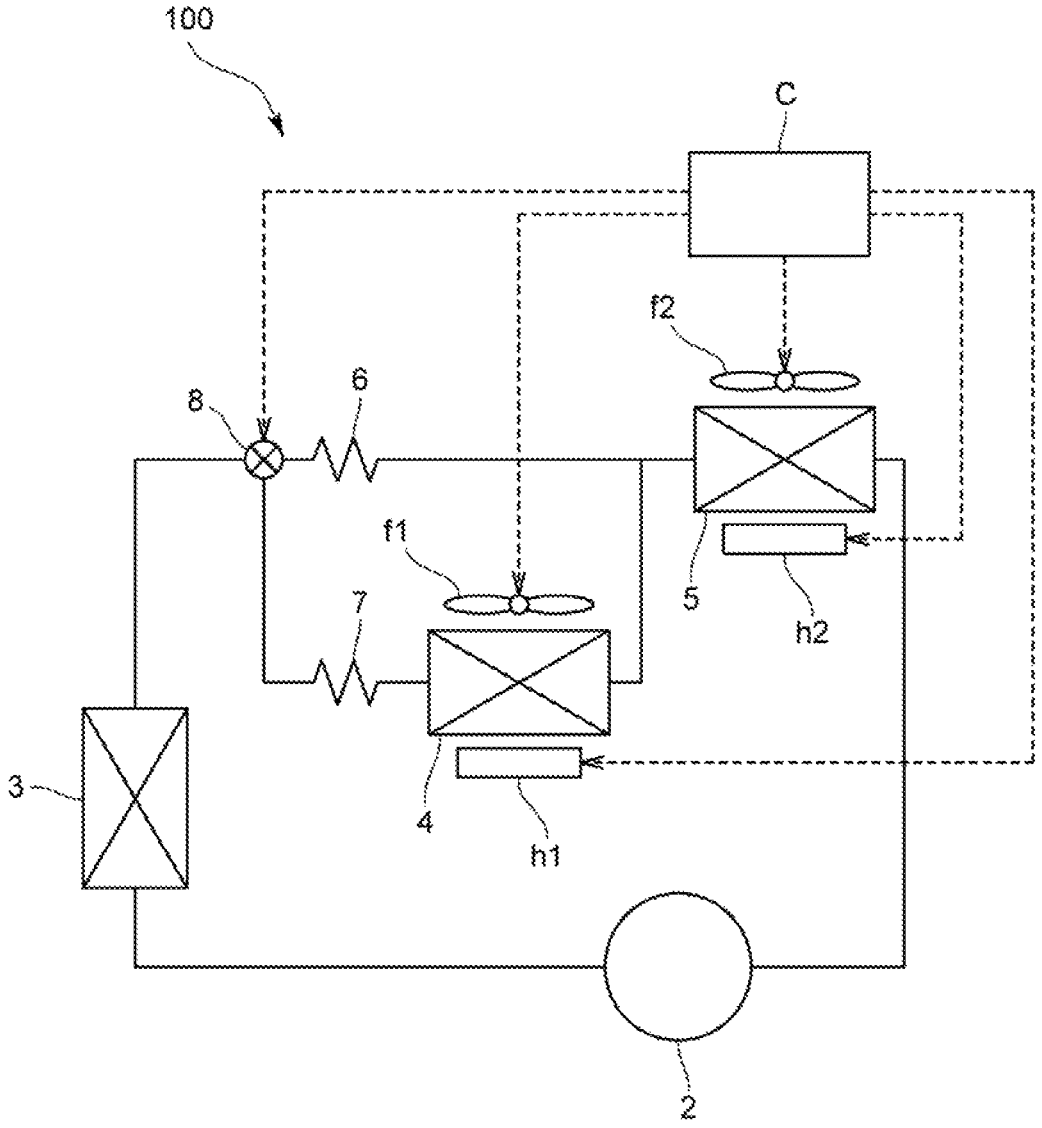
FIG. 12 is a conceptual diagram illustrating a cooling cycle of the refrigerator according to a sixth embodiment of the present disclosure.

As can be seen from FIG. 12, the refrigerator 100 according to the sixth embodiment may include a first defrosting heater (h1) for defrosting the refrigerating evaporator 4, a second defrosting heater (h2) for defrosting the freezing evaporator 5, a first blower fan (f1) for blowing air to the refrigerating evaporator 4, and a second blower fan (f2) for blowing air to the freezing evaporator 5.

The defrosting heaters h1 and h2 may be installed below the evaporators 4 and 5, respectively. The defrosting heaters (h1, h2) and the blower fans (f1, f2) may be controlled by the controller C.

In addition, the freezing evaporator 5 may include an evaporator temperature sensor (not shown) to detect a temperature of the outer surface of the freezing evaporator 5. For example, the evaporator temperature sensor may be installed to a refrigerant pipe of the freezing evaporator 5. The measured evaporator temperature (i.e., a detection signal) may be transferred to the controller C.

Therefore, the controller C may include a Central Processing Unit (CPU), a memory, and an analog-to-digital converter (ADC). Functionally, the controller C may operate with the CPU or the peripheral device according to the program stored in the memory. Therefore, the operation mode of the refrigerator 100 may switch to the cooling mode (or the cooling operation) or the defrosting mode (or the defrosting operation).

If the freezing temperature zone (i.e., the freezing chamber) is cooled by the common cooling operation, the controller C may open the freezing-chamber port of the flow passage switching valve 8 and may close the refrigerating-chamber port of the flow passage switching valve 8 so as to transfer the refrigerant to the freezing evaporator 5.

In addition, if the refrigerating temperature zone (i.e., the refrigerating chamber) is cooled, the controller C may open the refrigerating-chamber port of the flow passage switching valve 8 and may close the freezing-chamber port of the flow passage switching valve 8 so as to transfer the refrigerant to the refrigerating evaporator 4.

If the operation mode is switched from the common cooling mode to the defrosting mode, the controller C may open the freezing-chamber port of the flow passage switching valve 8.

In this case, it does not matter whether the refrigerating-chamber port is opened or closed. However, in order to remove a pressure difference between the suction part and the discharge part of the compressor 2, it may be more preferable that the refrigerating-chamber port be opened.

Figure 13:
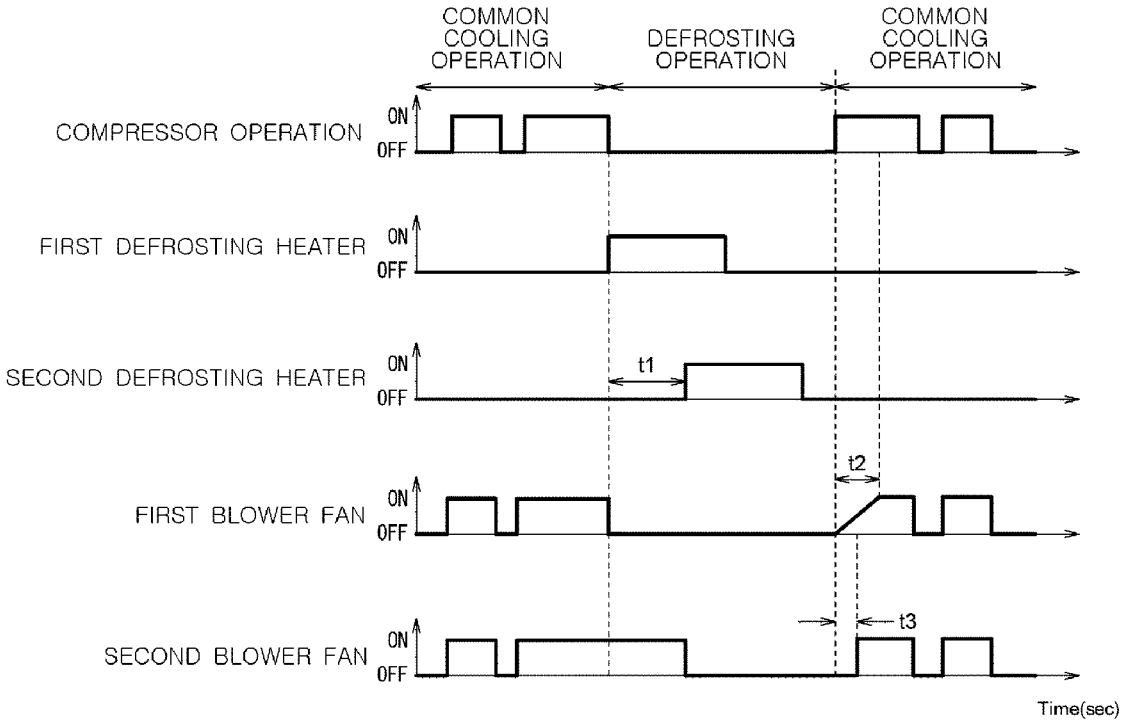
FIG. 13 is a conceptual diagram illustrating a method for controlling respective constituent elements of the refrigerator according to a sixth embodiment of the present disclosure.

As can be seen from FIG. 13, after the beginning of the defrosting operation, the controller C according to this embodiment may first drive the first defrosting heater (h1), and may drive the second defrosting heater (h2) after lapse of the first predetermined time (t1).

That is, after the beginning of the defrosting operation, the controller C may drive the first defrosting heater (h1). Thereafter, after lapse of the first predetermined time (t1), the controller C may drive the second defrosting heater (h2). During the above-mentioned process, the compressor 2 may be not driven.

The first time (t1) may be equal to or longer than a specific time generally consumed until the refrigerant heated by the refrigerating evaporator 4 arrives at the freezing evaporator 5 after the beginning of the defrosting operation. Although the first time (t1) may be generally set to 300 seconds or less, the scope or spirit of the present disclosure is not limited thereto, and the first time (t1) may be changed in response to various conditions according to structural types of the refrigerator.

In accordance with the above-mentioned characteristics, after the first defrosting heater (h1) starts operation, the second defrosting heater (h2) starts operation after lapse of the first time (t1), such that the freezing evaporator 5 can be defrosted within a time shorter than the conventional defrosting time, and the increasing of the inner temperature of the freezing chamber can be prevented.

Thereafter, after the controller C stops the first defrosting heater (h1), the controller C may re-stop the second defrosting heater (h2). After the first defrosting heater (h1) stops operation, a time needed to stop the second defrosting heater may be identical to the first time (t1). However, the first time (t1) may also be set to another time in response to various conditions according to structures of the refrigerator.

In addition, as shown in FIG. 13, the first blower fan (f1) may operate with air volume lower than basic air volume until the second time (t2) elapses after the operation mode is switched from the defrosting operation to the common cooling operation.

In more detail, the controller C may gradually increase the air volume level of the first blower fan (f1) from a specific time at which the operation mode is switched from defrosting operation to the common cooling operation. After lapse of the second time (t2), the controller C may control the first blower fan (f1) to operate at a basic air volume level.

In this case, the first blower fan (f1) may operate at the air volume level lower than the basic air volume level before expiration of the second time (t2), such that heat or warm air generated from the refrigerating evaporator 4 can be prevented from being introduced into the refrigerating chamber during the defrosting operation.

In addition, after the operation mode is switched from the defrosting operation to the common cooling operation, the controller C may stop the second blower fan (f2) before expiration of a third time (t3).

In more detail, a predetermined time needed when a difference between the temperature detected by the evaporator temperature sensor and the inner temperature of the freezing chamber satisfies a predetermined value (e.g., 2° C.) may be set to the third time (t3) by the controller C, and the controller C may stop the second blower fan (f2) during the third time (t3).

In this case, since the controller C stops the second blower fan (f2) during a predetermined time, heat or warm air generated by the freezing evaporator 5 can be prevented from being introduced into the freezing evaporator during the defrosting operation.

As can be seen from FIG. 13, after the operation mode is switched from the common cooling operation to the defrosting operation, the controller C may stop the second blower fan (f2) before expiration of the first time (t1), prior to operating the second defrosting heater (2).

In addition, the operation time of the second blower fan (f2) may be shorter than the first time (t1).

In this case, after the operation mode is switched from the common cooling operation to the defrosting operation, the second blower fan (f2) is driven for the first time (t1). As a result, before the second defrosting heater (h2) heats the freezing evaporator 5 after the beginning of the defrosting operation, the air cooled by the freezing evaporator 5 can be transferred to the freezing evaporator, resulting in prevention of the cooling efficiency deterioration.

In addition, the refrigerator 100 according to this embodiment may control the first blower fan (f1) to rotate in a reverse direction when the first defrosting heater (h1) is operated during the defrosting operation, and may control the second blower fan (f2) to rotate in a reverse direction when the second defrosting heater (h2) is operated during the defrosting operation.

The above-mentioned reverse rotation may have a direction of rotation opposite to the other rotation direction generated when ambient air of the respective evaporators (4, 5) is transferred to the refrigerating chamber or the freezing evaporator. In this case, ambient air of the respective evaporators (4, 5) may not be introduced into the freezing chamber or the refrigerating chamber.

Therefore, the above-mentioned refrigerator can more efficiently prevent ambient heat of the respective evaporators (4, 5) heated by the respective defrosting heaters (h1, h2) from being introduced into the refrigerating chamber or the freezing chamber.

In accordance with the above-mentioned refrigerator 100, the freezing evaporator 5 is arranged below the refrigerating evaporator 4, such that heat or warm air generated from the refrigerating evaporator 4 heated by the first defrosting heater (h1) can be transferred to the freezing evaporator 5 arranged in a downward direction through the flow of refrigerant.

In addition, the freezing evaporator 5 can be defrosted within a shorter time than in the related art, such that increase of the inner temperature of the freezing chamber can be prevented and heat generated by the refrigerating evaporator 4 can be prevented from being introduced into the refrigerating chamber. In addition, during the defrosting operation, the present disclosure may prevent heat generated by the freezing evaporator 5 from being introduced into the freezing chamber, and may prevent deterioration in the cooling efficiency.

The scope or spirit of the present disclosure is not limited thereto, and the present disclosure may be modified in various ways.

For example, before expiration of the second time (t2) after the operation mode is switched from the defrosting operation to the cooling operation, the controller C may gradually increase the air volume level of the first blower fan (f1). However, after the operation mode is switched from the defrosting operation to the common cooling operation, the controller C may also stop the first blower fan before expiration of the second time.

Although the controller C of the above-mentioned embodiment is characterized in that the first blower fan (f1) and/or the second blower fan (f2) rotate in a reverse direction during the operation time of the first defrosting heater (h1) and/or the second defrosting heater (h2) in the defrosting mode, the first blower fan (f1) and/or the second blower fan (f2) may stop operation without rotating in a reverse direction.

Figure 14:
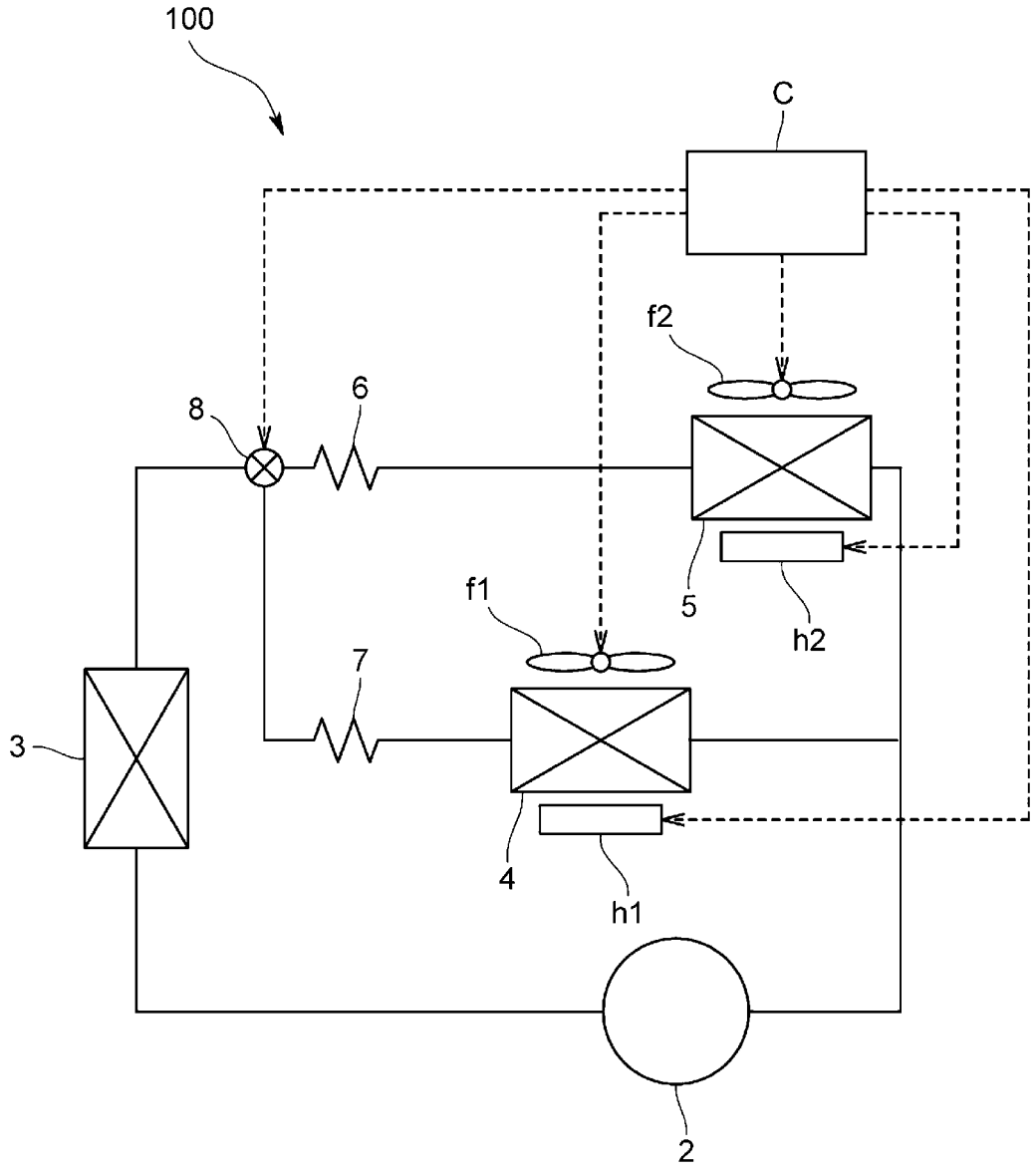
FIG. 14 is a conceptual diagram illustrating a cooling cycle of the refrigerator according to a modified example of the sixth embodiment of the present disclosure.

In addition, although the above-mentioned refrigerator includes the refrigerating evaporator 4 and the freezing evaporator 5 arranged in series, the refrigerating evaporator 4 and the freezing evaporator 5 may also be arranged in parallel as shown in FIG. 14.

In accordance with the above-mentioned structure, during the defrosting operation, after the controller C first operates the first defrosting heater (h1), the controller C operates the second defrosting heater (h2) after lapse of a predetermined time, such that heat generated from the refrigerating evaporator 4 heated by the first defrosting heater (h1) can be transferred to the freezing evaporator 5 through the flow of refrigerant. Therefore, the operation time of the second defrosting heater (h2) may be shorter than that of the related art, such that increase of the inner temperature of the freezing chamber can be prevented.

In addition, if the temperature measured by the evaporator temperature sensor 10 reaches a predetermined temperature (i.e., the defrosting start temperature, for example, −10° C.), the controller C may perform preliminary cooling of the freezing evaporator 5 and then operate the heaters.

In more detail, if the temperature measured by the evaporator temperature sensor 10 reaches the defrosting start temperature (e.g., −10° C.), the controller C performs preliminary cooling without stopping the heaters and the compressor. Thereafter, if the temperature detected by the evaporator temperature sensor 10 reaches a predetermined temperature (i.e., the heating start temperature, for example, −12° C.), the controller C operates the heaters.

The above-mentioned structure can prevent the inner temperature of the refrigerator from excessively increasing during the defrosting operation. In addition, the above-mentioned structure may be properly modified according to the defrosting start temperature or the structural characteristics of the refrigerator scheduled to perform heating, and it does not matter whether the refrigerating evaporator 4 instead of the freezing evaporator 5 can be preliminarily cooled.

The structure and characteristics of the present disclosure have been disclosed as described above with reference to the attached drawings.

In accordance with the present disclosure, the refrigerator includes the trap part in which warm air generated by the defrosting operation is trapped, such that warm air generated by the defrosting operation can be prevented from being introduced into the inner space of the refrigerator through the air passage.

In addition, the refrigerator according to the present disclosure can reduce the defrosting operation time, and can efficiently prevent increase of the inner temperature of the refrigerator, such that the inner temperature of the freezing chamber can be prevented from increasing. In addition, the refrigerator can prevent warm air from being introduced into the inner space of the refrigerator during the defrosting operation, can reduce a temperature difference in inner temperature of the refrigerator, and can prevent food stored in the refrigerator from rotting due to a temperature change.

Although the above-mentioned embodiments of the present disclosure have been disclosed herein merely for illustrative purposes, the scope or spirit of the embodiments is not limited thereto, and those skilled in the art will appreciate that various modifications, additions and substitutions are possible, without departing from the scope and spirit of the disclosure as disclosed in the accompanying claims. For example, adequate effects of the present disclosure may be achieved even if the foregoing processes and methods may be carried out in different order than described above, and/or the aforementioned elements, such as systems, structures, devices, or circuits, may be combined or coupled in different forms and modes than as described above or be substituted or switched with other components or equivalents.

As is apparent from the above description, the refrigerator for performing a defrosting process using a heater according to the embodiments of the present disclosure can reduce a time needed for the defrosting operation and at the same time can efficiently prevent increase of the inner temperature of the refrigerator, and can perform defrosting of a freezing evaporator. As a result, the refrigerator can prevent increase of an inner temperature of a freezing chamber.

In addition, the refrigerator can prevent warm air from being introduced into the refrigerator during the defrosting operation, and can reduce a difference in inner temperature of the refrigerator, such that it can prevent foods stored in the storage chamber(s) from decaying or spoiling according to temperature change.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a storage chamber;

an evaporator configured to cool the storage chamber;

an air passage through which cold air generated by the evaporator flows;

a fan configured to blow the cold air generated by the evaporator to the storage chamber through the air passage;

a trap part formed with a space to trap warm air generated by a defrosting operation, wherein the space is formed opposite an inlet through which the warm air is introduced into the space of the trap part by being guided away from the air passage during the defrosting operation;

a damper configured to open and close the air passage to control movement of the cold air; and an opening and a guide formed at both sides of the damper in such a manner that a refrigerant is introduced into the trap part when the damper is closed.

2. The refrigerator according to claim 1, further comprising:

a plurality of spray parts configured to distribute the cold air into the storage chamber; and partition parts formed at both sides of the plurality of spray parts, wherein the air passage is disposed between the partition parts, and the trap part is a space outside the partition parts.

3. The refrigerator according to claim 1, further comprising:

partition parts disposed above the damper, wherein the guide extends by a predetermined length along a direction of each of the partition parts such that the guide extends beyond a lowermost end of the partition parts by the predetermined length.

4. The refrigerator according to claim 3, wherein the predetermined length ranges from 10 mm to 100 mm.

5. The refrigerator according to claim 1, wherein the trap part includes a cooling material or a heat storage material.

6. The refrigerator according to claim 1, further comprising:

at least one processor configured to control the damper, wherein the at least one processor closes the damper during the defrosting operation, and opens the damper after completion of the defrosting operation.

7. The refrigerator according to claim 6, wherein:

the at least one processor opens the damper and drives the fan after completion of the defrosting operation, when a difference between an inner temperature of the storage chamber and an inner temperature of the evaporator satisfies a predetermined value, or if a predetermined time elapses.

8. The refrigerator according to claim 6, wherein:

while the damper is open, the at least one processor closes an opening to prevent a refrigerant from being introduced into the trap part.

9. The refrigerator according to claim 1, further comprising:

at least one defrosting heater to remove frost formed on the evaporator, by being arranged at one of an upper part of the evaporator and a lower part of the evaporator.

10. The refrigerator according to claim 9, wherein the at least one defrosting heater includes a defrosting heater located at the lower part and a defrosting heater located at the upper part, and during the defrosting operation, the defrosting heater located at the lower part of the evaporator has a higher output level than the defrosting heater located at the upper part of the evaporator.

11. The refrigerator according to claim 9, wherein the at least one defrosting heater includes a defrosting heater located at the lower part and a defrosting heater located at the upper part, and the fan rotates in a reverse direction while the defrosting heater located at the upper part of the evaporator is operated than a direction while the defrosting heater located at the lower part of the evaporator is operated.

* * * * *